US005269114A

United States Patent [19]

Albers et al.

[11] Patent Number: 5,269,114

[45] Date of Patent: Dec. 14, 1993

[54] COVER RETAINER FOR CONCRETE BLOCK WALL OPENING

[76] Inventors: James A. Albers, 11436 Fangorn Rd.; Garry L. Andrews, 1433 Pon Pon Court, both of Orlando, Fla. 32825

[21] Appl. No.: 950,708

[22] Filed: Sep. 25, 1992

[51] Int. Cl.[5] ..... E04B 1/38

[52] U.S. Cl. ..... 52/698; 52/127.7; 52/514

[58] Field of Search ..... 52/514, 127.7, 514, 52/698; 249/19, 33, 40, 142, 177, 219.1; 411/435, 437

[56] References Cited

U.S. PATENT DOCUMENTS

| | | | |
|---|---|---|---|
| 2,075,239 | 3/1937 | Strange . | |
| 3,298,657 | 1/1967 | Dercoli . | |
| 3,367,620 | 2/1968 | Holt . | |
| 3,920,214 | 11/1975 | Lovisa et al. . | |
| 3,926,400 | 12/1975 | Franc | 249/40 |
| 4,116,106 | 9/1978 | Barbour | 52/514 |
| 4,354,332 | 10/1982 | Lentz | 52/514 |
| 4,729,540 | 3/1988 | Rozema | 52/303 |
| 4,990,044 | 2/1991 | Kimak | 411/435 |
| 5,033,949 | 7/1991 | Jewett | 52/514 |
| 5,065,560 | 11/1991 | Yoder | 52/306 |

OTHER PUBLICATIONS

Drawing of Prior Art.

*Primary Examiner*—Carl D. Friedman
*Assistant Examiner*—Christopher T. Kent
*Attorney, Agent, or Firm*—James H. Beusse

[57] ABSTRACT

Apparatus for retaining a cover over a view port in a concrete block comprises a generally T-shaped bracket having a cross-arm and a support arm. The support arm extends generally perpendicularly from about a mid-point of the cross-arm. The cross-arm is generally longer than a width of the view port such that the cross-arm will not pass through the view port when the cross-arm is oriented in an operative position in alignment with the width of the port. A fastening area is formed on at least a portion of the support arm for passing through an aperture in the view port cover. A fastener is adjustably positionable on the fastening area for retaining the cover in compression against the block when the cross-arm is inserted in the view port in the operative position. The fastening area may be threaded for a wing nut or be adapted for receiving a push-nut.

11 Claims, 3 Drawing Sheets

COVER RETAINER FOR CONCRETE BLOCK WALL OPENING

BACKGROUND OF THE INVENTION

The present invention relates to building construction and, more particularly, to a method and apparatus for attaching an inspection plate to a block wall.

Building codes for concrete block wall construction require that a solid concrete pier be formed vertically through the wall at predetermined spaced intervals. The pier is also required to include reinforcing bar, commonly referred to as rebar, extending along a major vertical axis of the pier. In a conventional block wall, the individual concrete blocks are 8×8×16 inches and have a pair of openings extending from a top to a bottom surface. These openings are generally aligned as the blocks are stacked to form a wall. When the wall is completed to at least one floor height, rebar is inserted vertically through selected ones of the aligned openings.

The bottom-most block in each of the selected columns of aligned openings is a special block having one side of one opening cut out to form a viewing port into the block. The viewing port allows a building inspector to visually observe that rebar is installed in the column. Further, after concrete has been poured into the column, the port allows the inspector to confirm that the concrete has filled the column. However, it will be apparent that a cover must be installed over the viewing port during pouring of concrete and such cover must remain in place until the concrete has set.

The prior art includes wires attached to the rebar and brought out of the block for holding a cover, such as a plywood plate, in place over the port. The wire is fed through pre-drilled holes in the cover and fastened to hold the cover in position. The wire ends may be twisted together or each end twisted separately about a nail or other element.

It is believed that all prior methods of covering the view port have utilized some attachment to the rebar for holding a cover in place. One disadvantage of these methods is that the rebar may be pulled out of position by tightening of the cover. Another disadvantage is that the covers cannot be installed until after an inspector has approved placement of the rebar. Still another disadvantage is the relative difficulty in attaching wires to the rebar and in pulling sufficient force on the wires to hold the cover in place.

SUMMARY OF THE INVENTION

It is an object of the present invention to provide an apparatus for easily fastening a cover to a view port in a concrete block wall.

It is another object of the present invention to provide a cover apparatus which can be installed prior to inspection of a wall without impeding such inspection.

The above and other objects, features and advantages will be in part apparent and in part pointed out in the description to follow. The invention in an illustrative form includes an apparatus for retaining a cover over a view port in a concrete block wall. The apparatus generally comprises a T-shaped bracket having a cross-arm and a support arm. The support arm extends generally perpendicularly from about a mid-point of the cross-arm. The cross-arm is generally longer than a width of the view port which is to be covered such that the cross-arm will not pass through the view port when it is oriented in an operative position in alignment with the width of the port. The support arm includes threads or other types of fastening arrangements formed on at least a portion of the support arm for passing through an aperture in a view port cover to be placed over the view port. A fastener is adjustably positionable on the fastening portion of the support arm for retaining the cover in compression against the block wall when the cross-arm is inserted in the view port in an operative position. In one form, the support arm is formed with threads and the fastener comprises a wing nut. In another form, the support arm is formed with flexible tabs and the fastener is a push nut or other thin disk-like fastener which can be pushed down over the support arm and be retained in position by the flexible tabs. In the latter form, the disk may be provided with vertically upstanding members which can react against the shaft to maintain the disk in a plane normal to a longitudinal axis of the support arm. Preferably, the support arm exhibits a generally cross-shaped configuration in cross-section and includes a pair of braces extending from opposite sides of the arm and connected to adjacent surfaces of the cross-arm near the intersection point of the support arm and cross-arm for maintaining the position of the support arm with respect to the cross-arm. The cross-arm may also include a stiffener attached to a lower surface opposite the support arm and extending substantially over the extent of the cross-arm. In a preferred form, the cover comprises a generally transparent plastic plate having a central aperture for passage of the support arm. The cover may include a plurality of spaced stiffeners formed on a surface and extending from adjacent the central aperture to adjacent respective edges of the cover for providing support and stiffening of the plate.

BRIEF DESCRIPTION OF THE DRAWINGS

For a better understanding of the present invention, reference may be had to the following detailed description taken in conjunction with the accompanying drawings in which.

DETAILED DESCRIPTION

Figure 1:
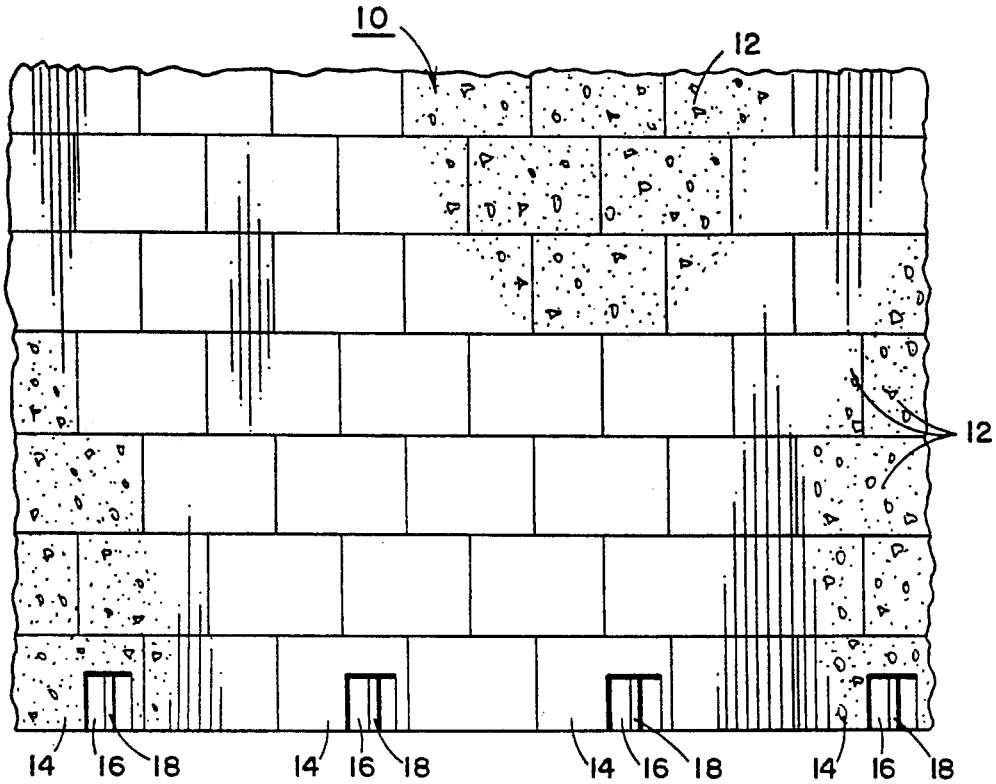
FIG. 1 is an elevation view of a block wall with which the present invention may be used.

FIG. 1 is a simplified illustration of a wall 10 formed by conventional stacking, with mortar joints, of concrete blocks 12. A bottom row of blocks 12 incorporates blocks 14 having access holes or view ports 16 cut out of the blocks. As is well known, the blocks 12 are typically 8×8×16 inches having a pair of spaced apertures extending from top to bottom, where top and bottom are defined by the stacked orientation shown in FIG. 1. When the wall 10 is properly laid, the apertures in the blocks 12 align vertically forming vertical hollow columns in the wall. In accordance with building codes, certain of these columns must be filled with reinforced concrete to form vertical spaced piers and adding additional strength to the wall. The blocks 14 are used in these column areas. The view ports 16 allow building inspectors to confirm that rebar 18 has been placed in the spaced columns and, after pouring of concrete into the columns, allows the inspectors to confirm that the concrete has reached the lowest block row.

Figure 2:
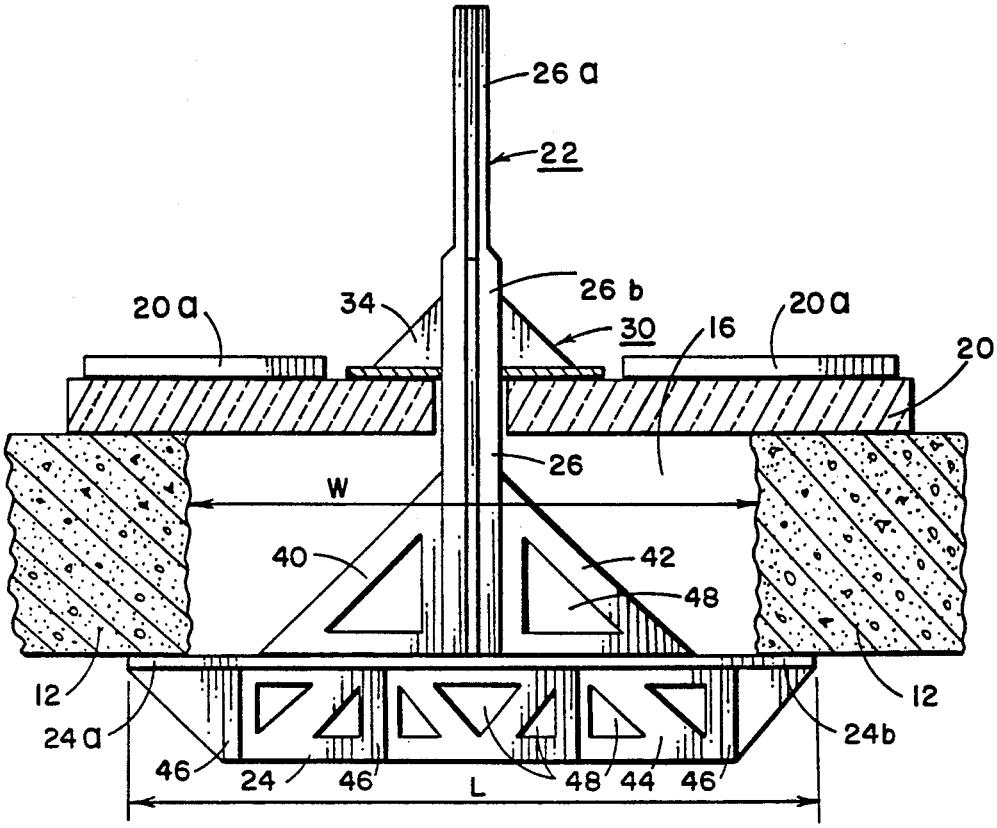
FIG. 2 is a plan view of the apparatus of the present invention in operative position on the wall of FIG. 1.

As is apparent, a cover must be placed over the view ports 16 while concrete is being poured into the columns so as to prevent the concrete from running out the ports. FIG. 2 is a top plan view of an apparatus in one form of the present invention for attaching an inspection plate or cover 20 over a view port 16 in a concrete block 12. The block 12 and cover 20 are shown in cross-section. The apparatus comprises a T-shaped bracket 22 having a cross-arm 24 and a support arm 26. The support arm 26 extends generally perpendicularly from about a mid-point of the cross-arm 24. The cross-arm 24 has a length L which is longer than the width W of the view port 16. The longer cross-arm 24 allows its ends **24*a* and 24*b* to be captured against the block 12 when the cross-arm is oriented in an operative position, i.e., in a horizontal plane as shown. The view port 16 is generally about five inches wide (the dimension W) and may extend vertically the full height of the block, i.e., about eight inches. The cross-arm 24 can be inserted in a vertical orientation and then rotated 90° into the orientation of FIG. 2**.

Figure 4:
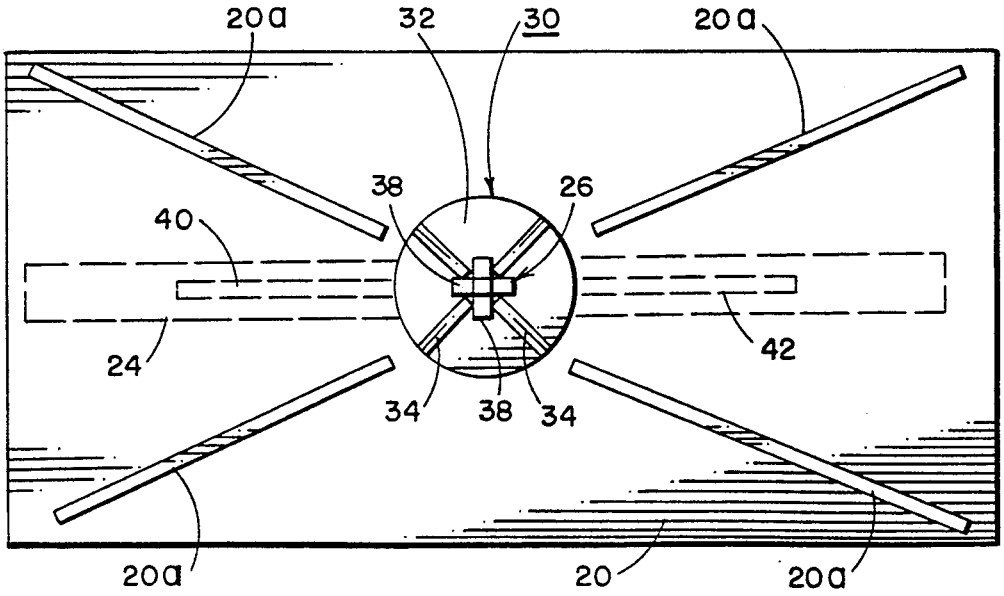
FIG. 4 is an end view transverse to the view of FIG. 1 of the apparatus of the present invention.
Figure 3:
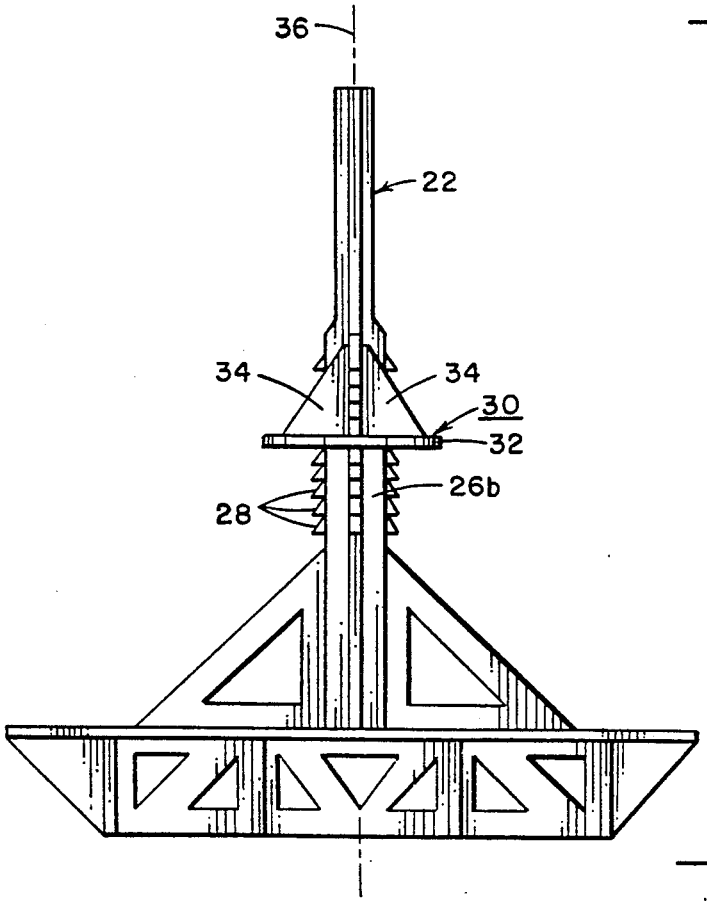
FIG. 3 is one modification of the apparatus of FIG. 2.

The support arm 26 extends outward of the view port 16 and may include a reduced diameter end **26*a* providing a convenient holding area for a user. At least a portion 26*b* of the support arm 24 may be formed with some form of fastener means such as threads or concentric flexible tabs. FIG. 3 shows portion 26*b* formed with such tabs 28. The tabs 28 allow a push-nut 30 to be used with bracket 22. A preferred form of push-nut 30 is shown in FIG. 3 and in the top plan view of FIG. 4 and comprises a relatively flat, disk shaped element 32 having a plurality of spaced members 34 extending from one surface and oriented for contacting the support arm 26. The members 34 contact the sides of the arm 26 and serve to maintain the element 32 in a plane normal to a longitudinal axis 36 of arm 26. As shown in FIG. 4, the support arm 26 is preferably formed with a cross-shape configuration and the members 34 abut against the intersections of each of the cross members 38 to maintain the alignment of element 32**.

It is also recognized that the portion **26*b* may be formed without threads or other elements and that the disk element 32 could be formed as a conventional thin metal disk having a small central aperture so that the disk deforms into a concave upward shape when the disk is pushed onto arm 24. The concave shape prevents removal of the disk. Such disks are well known and are commonly referred to as push nuts. The only requirement for portion 26*b* in this instance is that it be formed of a material sufficiently strong to resist excessive cutting by edges of the disk. However, the embodiment of FIG. 4 is preferred since it allows the fastener or push nut 30** to be formed of a plastic material.

Referring again to FIG. 2, the fastener 30 is pushed or threaded onto support arm 26 and into contact with view port cover 20. The cover 20 is preferably formed of a generally transparent plastic so that the cover can be installed prior to inspection, i.e., the transparent cover will allow an inspector to confirm presence of rebar 18 with the cover in place. This feature will allow the builder to be ready to pour concrete immediately upon inspection approval rather than having to install the covers after approval. The cover 20 may also include a plurality of spaced stiffeners **20*a* extending from adjacent the central aperture to adjacent the edges of the plate for increased rigidity. In the view of FIG. 4, taken transverse to the view of FIG. 2, the cover 20** can be seen to have four stiffeners.

As is shown in FIG. 2 and in phantom lines in FIG. 4, the bracket 22 may include side braces 40, 42 for strengthening cross arm 24 against lateral motion and provide a more rigid attachment to support-arm 26. In addition, the support-arm 24 includes a stiffener 44 extending substantially the length of the arm 24. The stiffener 44 may include lateral braces 46. Both the stiffener 44 and braces 40, 42 preferably include cut out areas 48 to reduce the volume of material in the bracket 22. The bracket 22 is desirably formed by plastic molding as a unitary structure and volume reduction affects material cost.

Figure 5:
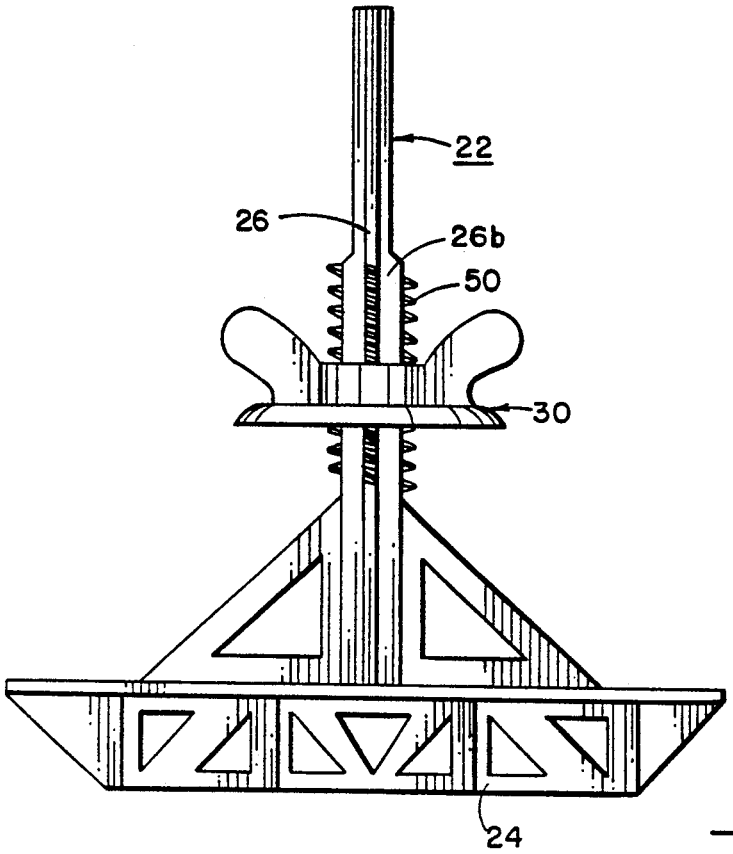
FIG. 5 is another modification of the apparatus of FIG. 1.

Referring to FIG. 5, there is shown another form of fastener 30 for use with bracket 22. In this form, fastener 30 comprises a wing nut and the fastening means comprises threads 50 formed on portion **26*b* of support arm 26**.

Figure 6A:
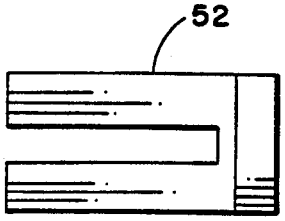
FIG. 6A is a plan view of the wedge of FIG. 6.
Figure 6B:
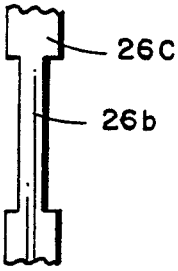
FIG. 6B is a partial view taken transverse to FIG. 6.
Figure 6:
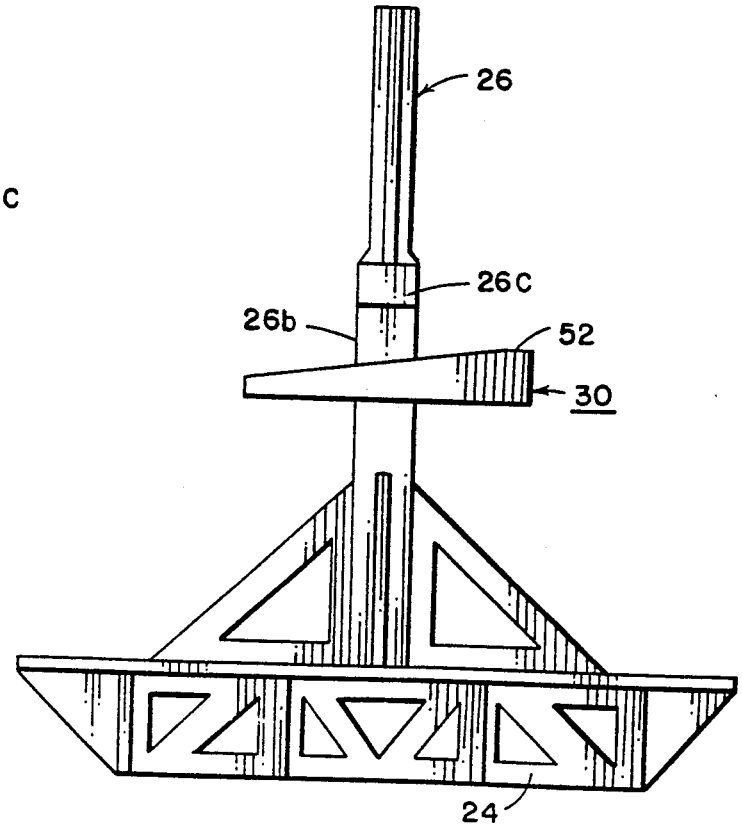
FIG. 6 is another modification of the apparatus of FIG. 1.

FIG. 6 illustrates still another form in which the fastening means comprises a cutaway portion of support arm 24, i.e., the cross pieces **26*c* on opposite sides of portion 26*b* are removed. The fastener 30 is a bifurcated wedge 52, see FIG. 6A, which can be driven between the pieces 24*c* and the cover 20. For this embodiment, it is desirable to modify the upper cross pieces 24*c* to increase their width so as to provide adequate strength for restraining the cover, while narrowing the width at 24*b* to accept the wedge 52 as shown in FIG. 6B taken transverse to FIG. 6**.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. Apparatus for retaining a view port cover over a view port in a concrete block, said view port cover having an aperture, said view port having a width, said apparatus comprising:

a generally T-shaped bracket including a rigid cross-arm having a midpoint, said bracket further including a support arm which is integrally formed as a part of said bracket, said support arm extending generally perpendicularly from about the mid-point of said cross-arm, said cross arm being generally longer than a width of the view port such that said cross-arm will not pass through the view port when said cross-arm is oriented in an operative position in alignment with the width of the view port;

a fastener receiver formed on at least a portion of said support arm for passing through the aperture in said view port cover; and a fastener adjustably positionable on said fastener means for retaining said view port cover in compression against the block when said cross-arm is inserted in the view port in the operative position.

2. The apparatus of claim 1 wherein said fastener receiver comprises threads on said support arm and said fastener comprises a nut.

3. The apparatus of claim 1 wherein said fastener comprises a push-nut,

4. The apparatus of claim 1 wherein said fastener comprises a relatively flat, disk shaped element having a plurality of circumferentially spaced members extending from a surface thereof and oriented for contacting said portion of said support arm when said fastener is positioned on said support arm for maintaining said disk shaped element in a plane normal to a longitudinal axis of said support arm.

5. The apparatus of claim 3 wherein said fastener receiver comprises a plurality of angularly oriented flexible tabs extending radially from said support arm, said tabs being oriented to inhibit removal of said push-nut.

6. The apparatus of claim 4 wherein said support arm exhibits a generally cross-shaped configuration in cross-section, said spaced members being oriented to align with intersecting corners of said configuration.

7. The apparatus of claim 6 and including a pair of braces extending from opposite sides of said support arm and connected to an adjacent surface of said cross-arm.

8. The apparatus of claim 7 and including a stiffener attached to another surface of said cross-arm and extending substantially over the extent of said cross-arm.

9. An assembly for covering a view port in a concrete block comprising:

a view port cover having a predetermined width and an aperture passing therethrough generally centrally of said cover;

a generally T-shaped bracket including a rigid cross-arm having a midpoint, said bracket further including a support arm which is integrally formed as a part of said bracket, said support arm extending generally perpendicularly from about the midpoint of said cross-arm, said cross-arm being generally longer than a width of the view port such that said cross-arm will pass through the view port when said cross-arm is oriented in an operative position in alignment with the width of the view port;

a fastener receiver formed on said at least a portion of said support arm for passing through the aperture in said view port cover; and a fastener adjustably positionable on said fastener means for retaining said view port cover in compression against the block when said cross-arm is inserted in the view port in the operative position.

10. The assembly of claim 9 wherein the cover comprises a generally transparent plastic plate in which said aperture is centrally situated, said aperture being designated a central aperture.

11. The assembly of claim 10 wherein said cover includes a plurality of spaced stiffeners extending from adjacent said control aperture to adjacent repective edges of said cover.

* * * * *